US005557900A

United States Patent [19]

Shaneour

[11] Patent Number: 5,557,900

[45] Date of Patent: Sep. 24, 1996

[54] PLAYGROUND STRUCTURAL MEMBER USING RECYCLED PLASTIC

[75] Inventor: Dwight C. Shaneour, Hillsdale, Mich.

[73] Assignee: The Shane Group, Inc., Hillsdale, Mich.

[21] Appl. No.: 528,983

[22] Filed: Sep. 15, 1995

[51] Int. Cl.[6] ..... E04C 3/30

[52] U.S. Cl. ..... 52/736.3; 52/720.1; 24/278; 472/4

[58] Field of Search ..... 52/720.1, 720.2, 52/736.1, 736.3, 736.4, 738.1, DIG. 8, DIG. 5, DIG. 9; 24/278, 279, 284; 285/90, 404; 472/4, 5, 1

[56] References Cited

U.S. PATENT DOCUMENTS

| | | | |
|---|---|---|---|
| 2,355,165 | 8/1944 | Jerman | 24/284 |
| 2,838,100 | 6/1958 | Follows | 155/191 |
| 2,973,961 | 3/1961 | Behrens | 472/4 |
| 2,994,327 | 8/1961 | Otto et al. | 132/39 |
| 3,080,149 | 3/1963 | Pilboue | 52/736.3 |
| 3,199,868 | 8/1965 | Motyka | 472/5 |
| 3,205,626 | 9/1965 | Attenberger | 52/736.3 X |
| 3,652,748 | 3/1972 | Roberts | 264/45 |
| 3,810,337 | 5/1974 | Pollard | 52/223 R |
| 3,991,146 | 11/1976 | Barrie | 264/46.7 |
| 4,363,505 | 12/1982 | Smith | 285/404 X |
| 4,861,075 | 8/1989 | Pepi et al. | 24/279 X |
| 4,907,828 | 3/1990 | Chang | 285/404 X |

*Primary Examiner*—Kien T. Nguyen
*Attorney, Agent, or Firm*—Duncan F. Beaman

[57] ABSTRACT

A playground structural member characterized by its economy of manufacture, durability and colorfastness consisting of an elongated steel tube core encapsulated within an envelope formed of recycled synthetic plastic, preferably of the polyethylene type. The upper end of the structural member includes a bulbous head, and the lower length is of a cylindrical configuration adapted to receive brackets having attachment tabs whereby the structural members may function as supporting columns for playground apparatus.

9 Claims, 1 Drawing Sheet

PLAYGROUND STRUCTURAL MEMBER USING RECYCLED PLASTIC

BACKGROUND OF THE INVENTION

1. Field of the Invention

The invention pertains to playground structural members, preferably columns, of an attractive colorfast appearance capable of supporting platforms, slides and other playground apparatus.

2. Description of the Related Art

Playground apparatus for children includes swings, platforms, climbers, slides, ramps, bridges, and a variety of structural members interconnected by clamps and connections. Such equipment is normally mounted outdoors and is subjected to rain, sleet, sun, dust, insects, rot and other deleterious environmental factors. Such playground equipment usually consists of galvanized steel tubing welded or interconnected by bolt-on type connectors, flanges and couplings.

It is important that playground equipment be maintained in excellent condition to minimize the likelihood of harm to the children using the equipment, and rust, splinters, burrs, and the like can inflict injury and detract from the appearance of the equipment, which is important to the acceptance and use of the apparatus.

There is a continuous search for improved materials, coverings, paint, surfacing, and the like, in order to render playground equipment safer, more attractive, more durable and acceptable for its intended purpose. The invention pertains to a unique solution toward this goal.

OBJECTS OF THE INVENTION

It is an object of the invention to provide a playground structural member, particularly a column, capable of supporting playground apparatus which is attractive, durable, colorfast, safe and highly resistant to corrosion and insects.

Another object of the invention is to provide a playground structural member of an attractive appearance, high structural strength, having a safe "soft" feel and covering which utilizes recyclable synthetic plastic materials.

Yet another object of the invention is to provide a playground structural member having a steel tube core encased within an envelope formed by recyclable synthetic plastic material, such as polyethylene, wherein the envelope is colorfast and less likely to injure playing children than steel surfaced playground equipment.

SUMMARY OF THE INVENTION

Basically, a playground structural member in accord with the invention consists of a steel tube encased within an envelope of synthetic plastic recycled material, such as polyethylene. Preferably, the structural member includes an upper enlarged head of a spheroid configuration, and the primary portion of the structural member between the head and its lower end is of a cylindrical exterior form defining a substantially uniform wall thickness of synthetic plastic material between the steel tube core and the outer surface of the synthetic plastic envelope. The synthetic material extends the full length of the structural member wherein the lower end of the envelope and the tube coincide.

The structural member in accord with the invention may be employed in a number of ways. Usually, the structural member is employed as a column for supporting playground platforms, slides, bridges, shelters and the like. In most instances, a compression clamp circumscribes the cylindrical surface of the member which supports a bracket upon which the platform, slide, etc. may be mounted. The compression clamp may include a radial pin or key which penetrates the synthetic plastic envelope for connection to the core tube to prevent relative rotation and axial movement between the bracket and the structural member.

The structural member envelope is formed of a recycled synthetic plastic, preferably commingled, high density polyethylene (HDPE) (2) and low density polyethylene (LDPE) (4). However, formulations of similar plastic materials may be used for the structural member envelope, but such recycled material is preferable.

The recycled material is initially dyed the desired color wherein the color will exist throughout the envelope thickness and is resistant to fading due to exposure from ultraviolet and sunlight.

The synthetic plastic recycled material envelope is also "soft" to the feel as compared to a steel column, and because of the softer material and limited compressibility of the envelope, the likelihood of children being injured by encounter with the structural member is reduced.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
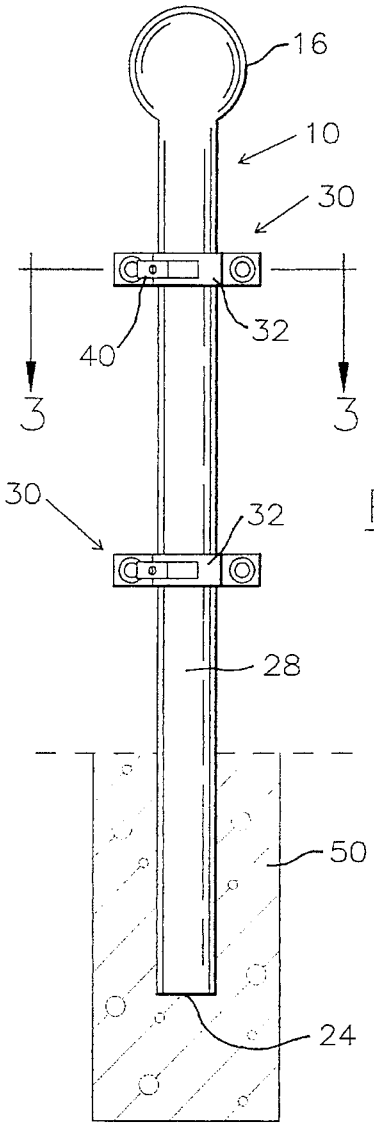
FIG. 1 is an elevational view of a structural member in accord with the invention as embedded within a concrete footing, a pair of mounting brackets being attached thereto.

With reference to the figures, a structural playground member in accord with the inventive concept is generally indicated at 10, and primarily consists of a core tube 12 encased within a synthetic plastic envelope 14. The upper region of the structural member usually includes an enlarged head 16 formed by the plastic material which may be in the illustrated spheroid configuration.

The core tube 12 is preferably formed of a straight piece of conventional steel pipe, such as of the one and one-quarter inch ID, and includes upper end 18 and a lower end 20. The synthetic plastic envelope 14 includes an upper end 22, upon which the head 16 is defined, and the lower end of the envelope is represented at 26. As will be appreciated from FIGS. 1 and 2, the lower ends of the core tube and envelope coincide, and the core lower end intersects the envelope lower end 22.

The stem portion of the structural member 10, i.e. that portion between the head 16 and the envelope lower end 24, is preferably of a cylindrical configuration of substantially uniform wall thickness as defined by the exterior cylindrical surface of the tube 12 and the exterior cylindrical stem surface 28.

It is an aspect of the invention that the envelope 14 be formed of a recycled synthetic plastic material. Preferably, the envelope 14 is formed of a commingled, recycled, high density polyethylene (HDPE) (2) and a low density polyethylene (LDPE) (4), but the formulation of the envelope 14 may also include plastics from other Society of Plastics Industries primary material groups. The material of the envelope 14 is treated with additives and dye to obtain the desired color throughout the thickness of the envelope, and such additives incorporated into the recycled synthetic plastic material normally amounts to about four percent by weight of the finished product.

The recycled material of the envelope 14 resists insects, termites, boring worms, microbe activity and wet rot often found in outdoor environments, furthermore, the envelope will not split, splinter or rot and does not absorb moisture or promote bacterial or barnacle growth. Ultra-violet stabilizers are incorporated into the envelope material to insure and enhance the long life characteristics of the colors and plastics employed. The preferred physical properties and the typical values thereof of the material of the envelope 14 are set forth below:

Density: 0.917 to 0.980 g /cc (ASTM D792)

Compressive strength: 0.3200–3800 lbs/in

Tensile strength: 1470–1700 psi

Flexural modulus: $1.6\times10^5$ psi

Hardness (shore D): 65 shore D

Izod impact: 2.8 (ft/lb/in$^2$)

Coefficient of thermal expansion: $70\times10.^6$ (in/in F)

Screw withdrawal: 140 lbs (6 Penny Common Bright)

Electrical properties: $10^{15}$ (ohm-cm) (ASTM D257)

Water absorption: 0.01% 24 hours (ASTM D570)

Figure 2:
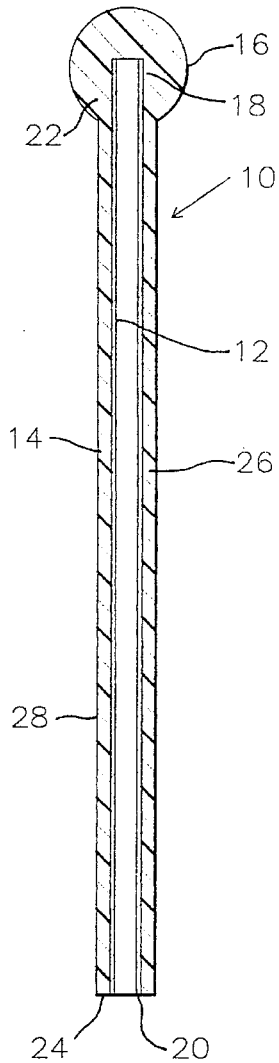
FIG. 2 is an elevational diametrical sectional view of the structural member of the invention, per se.

The structural member 10 may be employed as a column or support for a wide variety of playground equipment including platforms, slides, ramps, bridges, tubes, steps, stairs, climbers, and the like. In order to attach such playground equipment to the structural member 10, brackets 30 may be mounted as desired along the structural member stem 26, as shown in FIG. 1.

Figure 3:
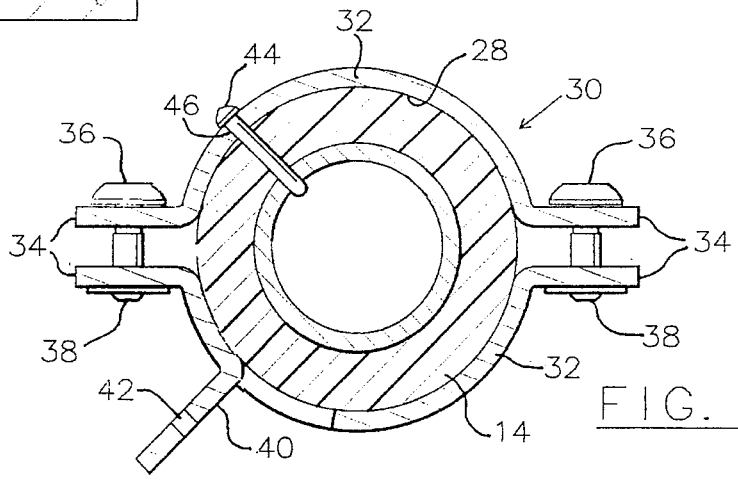
FIG. 3 is a plan sectional view as taken through a mounting bracket and clamp along Section 3—3 of FIG. 1.

The brackets 30, a wide variety of constructions thereof which might be employed, one type being shown, include clamp elements 32, FIG. 3, which each circumscribe a little less than one-half of the stem surface 28. The clamp elements 32 including radial extending ears 34 which may be pulled toward each other by tightening of the buttonhead bolts 36 threaded into the tee nuts 38.

The structure mounted upon the brackets 30 is attached to the mounting tab 40 lanced from a clamp element 32, and the mounting tab 40 includes a hole 42 for receiving an attachment bolt whereby the component supported by the structural member may be attached thereto.

If it is desired that the bracket 30 be locked to the structural member 10 to prevent relative rotation or axial movement thereto, a drive screw 44 may extend through the clamp element hole 46, through the material of the envelope 14 and into the hole 48 defined in the core tube.

In many instances, the structural member 10 will be mounted in a vertical position by cementing the lower region of the structural member in a concrete footing as represented at 50 in FIG. 1.

It will be appreciated that a structural member in accord with the inventive concepts consisting of a rigid core tube located within a synthetic plastic recycled material envelope has many advantages, both structurally and aesthetically. In addition to the colorfastness, and resistance to various types of deterioration and corrosion, the envelope 14, as formed of a recycled synthetic plastic material, will have a softer feel than a structural member formed of steel, and is capable of absorbing limited impact rendering the structural member preferable in instances wherein children's heads and limbs may engage the member.

It is appreciated that various modifications to the inventive concepts may be apparent to those skilled in the art without departing from the spirit and scope of the invention.

I claim:

1. A playground structural member characterized by its economy of manufacture, durability and color fastness comprising, in combination, a rigid elongated metal tube having an upper end, a lower end, an axis and an outer surface, an envelope formed of recycled synthetic plastic material encasing said tube throughout its length and outer surface, said envelope having an upper end, a lower end and an outer surface, said envelope upper end comprising an enlarged head adjacent said tube upper end, the envelope wall thickness as defined by said tube outer surface and said envelope outer surface between said head and said envelope lower end being substantially uniform and said envelope outer surface between said head and envelope lower end being cylindrical, a bracket circumscribing said envelope cylindrical outer surface, said bracket including a circumferentially contractible clamp, operating means selectively contracting said clamp for firmly mounting said bracket upon said envelope, and an attachment tab mounted upon said bracket.

2. In a playground structural member as in claim 1, said envelope being formed of recycled polyethylene.

3. In a playground structural member as in claim 2, said envelope being formed of commingled high density polyethylene and low density polyethylene.

4. In a playground structural member as in claim 2, the material of said envelope having a density between 0.917–0.980 g/cc (ASTM D792).

5. In a playground structural member as in claim 2, the material of said envelope having a compressive strength of 0.3200–3800 lbs/in.

6. In a playground structural member as in claim 2, the material of said envelope having a hardness (shore D) of 65 shore D.

7. In a playground structural member as in claim 2, the material of said envelope having a coefficient of thermal expansion of $0.70\times10^6$ (in/in F).

8. In a playground structural member as in claim 1, said head being of a spheroid configuration.

9. In a playground structural member as in claim 1, a pin radially extending through said bracket and said tube preventing relative rotational and axial movement between said bracket and said structural member.

* * * * *